US006954943B1

(12) United States Patent
Boyko

(10) Patent No.: US 6,954,943 B1
(45) Date of Patent: Oct. 18, 2005

(54) NECKWEAR RESTRAINING DEVICE AND METHOD

(76) Inventor: Larry A. Boyko, 13 Ellsworth La., Pelham, NH (US) 03076

( * ) Notice: Subject to any disclaimer, the term of this patent is extended or adjusted under 35 U.S.C. 154(b) by 140 days.

(21) Appl. No.: 10/686,239

(22) Filed: Oct. 15, 2003

(51) Int. Cl.[7] ..... A41D 25/16
(52) U.S. Cl. ..... 2/156
(58) Field of Search ..... 2/144, 145, 146–151, 2/152.1, 153–157; 24/49.1, 54, 65, 66.1

(56) References Cited

U.S. PATENT DOCUMENTS

| | | | | |
|---|---|---|---|---|
| 1,291,090 | A | 1/1919 | Nuzum | |
| 2,006,427 | A | 7/1935 | Wolfson | |
| 2,738,513 | A * | 3/1956 | Carty | 2/145 |
| 2,746,055 | A | 5/1956 | Gleason | |
| 2,749,553 | A | 6/1956 | Miller | |
| 3,474,503 | A * | 10/1969 | Less | 24/56 |
| 4,554,710 | A | 11/1985 | Grant | |
| 4,827,576 | A * | 5/1989 | Prince, Jr. | 24/66.1 |
| 4,835,821 | A | 6/1989 | Durante | |
| 4,920,579 | A | 5/1990 | Swain | |
| 4,955,112 | A | 9/1990 | Porter | |
| 4,972,523 | A | 11/1990 | Begg | |
| 5,007,139 | A | 4/1991 | Ahern | |
| 5,046,221 | A | 9/1991 | Walker | |
| 5,095,546 | A | 3/1992 | Jones | |
| 5,109,547 | A | 5/1992 | Abdallah | |
| 5,216,785 | A | 6/1993 | Graef | |
| 5,235,730 | A | 8/1993 | Townsend | |
| 5,245,708 | A | 9/1993 | Campelia et al. | |
| 5,315,713 | A | 5/1994 | Pileggi | |
| 5,337,457 | A | 8/1994 | Chennault | |
| 5,353,438 | A | 10/1994 | Voiles | |
| 5,715,538 | A | 2/1998 | Soll | |
| D399,171 | S | 10/1998 | McNamara | |
| 5,926,923 | A | 7/1999 | Smith | |
| D420,778 | S | 2/2000 | Roberts | |
| 6,070,434 | A * | 6/2000 | Traver | 63/1.11 |
| 6,131,200 | A | 10/2000 | McNamara | |
| 6,163,933 | A | 12/2000 | Smith | |
| 6,182,292 | B1 | 2/2001 | Knoll | |
| 6,216,275 | B1 | 4/2001 | Lee | |

* cited by examiner

*Primary Examiner*—Tejash Patel
(74) *Attorney, Agent, or Firm*—McLane, Graf, Raulerson & Middleton Professional Association

(57) ABSTRACT

Restraining devices for neck apparel, such as a necktie, for attaching an item of neck apparel in place on the shirt of a person wearing an item of neck apparel are provided, the shirt being of a type having a plurality of buttons spaced along its front. The restraining device comprises an elongate, flexible cord having a first button loop formed at a first end of the cord and a second button loop formed at a second end of the cord opposite the first end. The first and second button loops are adapted to releasably engage adjacent ones of the plurality of shirt buttons. In a further aspect, methods of securing a neck apparel device to a shirt are also provided.

25 Claims, 3 Drawing Sheets

NECKWEAR RESTRAINING DEVICE AND METHOD

BACKGROUND OF THE INVENTION

The present invention relates to a removable necktie restraining device for retaining a necktie or other neck apparel item in a substantially centered, straight-down position. While the present invention will be shown and described herein primarily by way of reference to long, straight ties of a type worn with a folded down shirt collar, e.g., four-in-hand ties, it will be recognized that the present invention may also be used in conjunction with scarves or other articles of neck apparel.

SUMMARY OF THE INVENTION

In a first aspect, a neck apparel restraining device for attaching an item of neck apparel in place on the shirt of a person wearing an item of neck apparel is provided, the shirt being of a type having a plurality of buttons spaced along its front. The restraining device comprises an elongate, flexible cord having a first button loop formed at a first end of the cord and a second button loop formed at a second end of the cord opposite the first end. The first and second button loops are adapted to releasably engage adjacent ones of the plurality of shirt buttons.

In a second aspect, a method of securing a neck apparel item to a shirt having a plurality of spaced-apart button includes providing an item of neck apparel of a type having at least a portion to be worn in a centered position, the item of neck apparel further including a loop member defining an opening and placing a restraining device through the loop member, the restraining device comprising an elongate and flexible cord. A first button loop is formed at a first end of the cord, and a second button loop is formed at a second end of the elongate flexible cord opposite the first end. The first button loop is removably attached to a first button on the shirt, the first button being the most proximate button on the shirt to the first button loop. The second button loop is removably attaching the second button loop to a second button on the shirt, the second button being the most proximate button on the shirt to the second button.

In a third aspect, a necktie restraining device for attaching a necktie in place on the shirt of a person wearing a necktie, the shirt being of a type having a plurality of buttons spaced along its front, the necktie being of a type having a tie loop formed on an inward facing surface thereof. The restraining device comprises an elongate elastic cord, a first button loop formed at a first end of the cord, and a second button loop formed at a second end of the cord opposite the first end. The first and second button loops are adapted to releasably engage adjacent ones of the plurality of shirt buttons.

BRIEF DESCRIPTION OF THE DRAWINGS

The accompanying drawings, which are incorporated in and constitute a part of the specification, illustrate embodiments of the invention and together with the description of the invention herein, serve to explain the principles of the invention.

DETAILED DESCRIPTION OF THE PREFERRED EMBODIMENT

Figure 2:
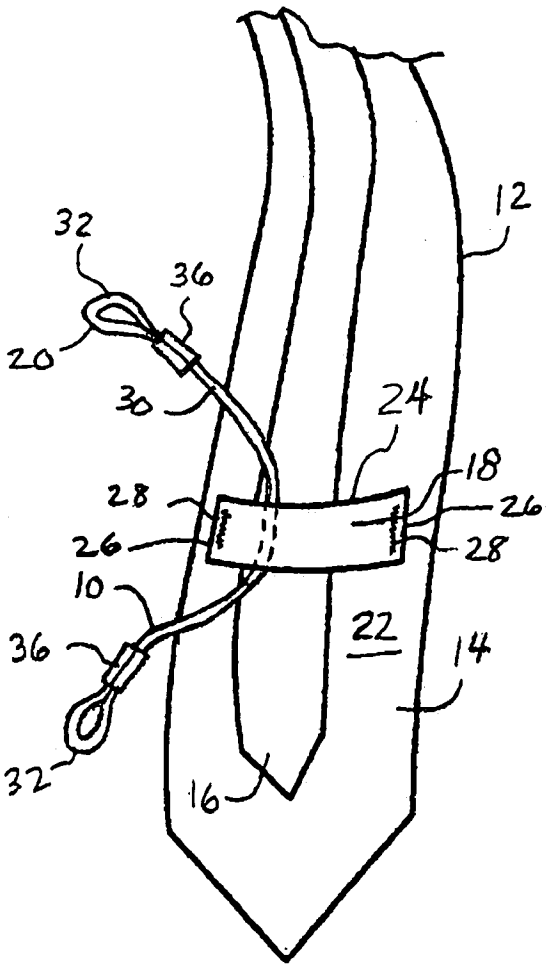
FIG. 2 illustrates the manner of attaching the neckwear retaining device of FIG. 1 to a necktie.
Figure 1:
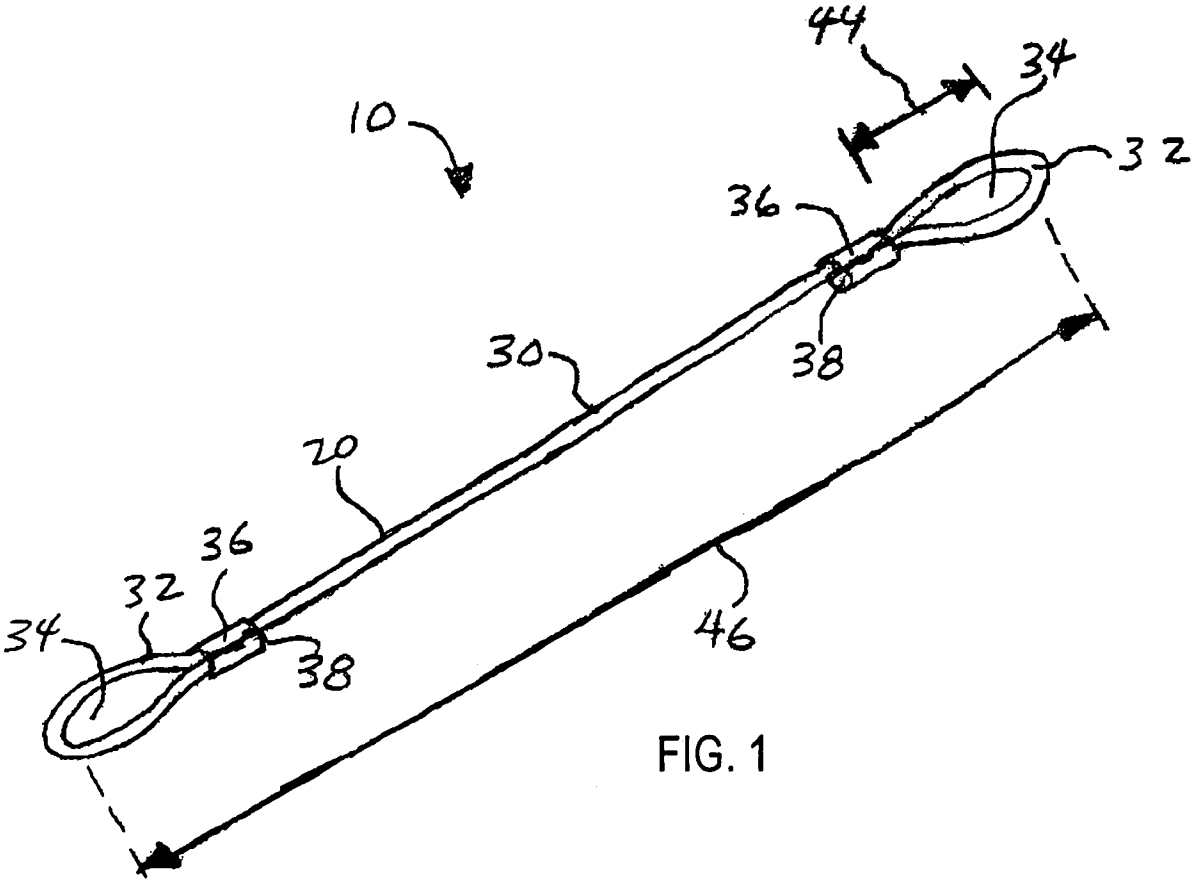
FIG. 1 illustrates a first embodiment of the neckwear restraint device according to the present invention.

Referring now to the drawing figures, wherein like reference numerals are used to designate like components throughout the several views, there appears in FIGS. 1–5 a neck apparel restraining device 10 of the present invention. The neckwear restraining device 10 is particularly adapted for use with a necktie 12, e.g., a so-called four-in-hand tie, although scarves or other neck wear items are contemplated as well. In the preferred embodiment, the necktie 12 is of the type including a wide tail 14, a narrow tail 16, and a loop member 18 secured to or otherwise formed on an inward facing surface 22 of the wide tail 14 to define an opening or passage 24.

The loop member 18 may be, for example, a label or a cloth member which is generally sewn or otherwise fastened to the inward surface 22 the wide tail 14. The narrow tail 16 of the necktie 12 may be passed through the opening 24 defined by the loop member 18. In the depicted embodiment, the loop member 18 extends transversely with respect to the long axis of the necktie 12, and may be secured to the necktie inward surface 22 at the transversely spaced apart ends 26 via stitching 28 or other means. Alternatively, the loop member 18 may form a complete loop of material sewn or otherwise attached to the inward surface 22 at a single, centrally located point.

The tie restraining device 10 is formed of an elongate, flexible cord 20, most preferably an elastic, stretchable, and or resilient cord, and includes a main body portion 30 and first and second button loops 32 formed at opposite ends of the main body 30. The button loops 32 define apertures or openings 34 which are sized and spaced to receive adjacent shirt buttons 40.

The elastic cord forming the device 10 may be formed of one or more strands of an elastic material, such as natural or synthetic rubber, and may be covered with a cloth material, e.g., an elastic, stretchable, or woven cloth material, or the like. Advantageously, the elastic cord material may be of a type commonly employed in the manufacture of elastic bands for securing or retaining ponytails. The elastic cord may have a diameter of from about 1/16 inch to about 1/8 inch, although cords of other diameters may be employed.

The button loops 32 are formed by securing each of the ends 38 of the cord forming the article 10 to the main body 30 with a fastener 36. The cord ends 38 are secured at a position to create the button openings 34 of appropriate dimension 44 to removably receive a shirt button 40 therethrough. In a preferred embodiment, the opening 34 has a dimension 44 of about 0.5 inches extending in the longitudinal direction of the article 10, although other dimensions are contemplated.

Figure 5:
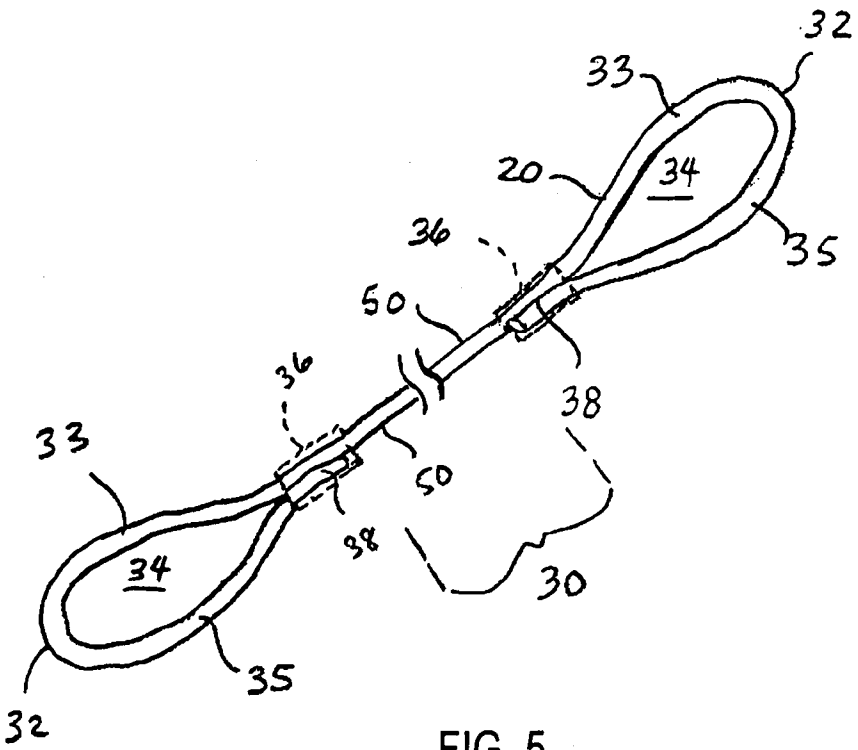
FIG. 5 is an enlarged view of the button loops according to an exemplary embodiment of the present invention.

As best seen in FIG. 5, each of the button loops 32 adapted to be removably secured to a shirt button may be made up of the first and second runs 33 and 35 of the elastic cord 20, which are interconnected in side-by-side manner by the clamp or clasp 36, for example, a metal band or clamp encircling the two runs 33 and 35 which may form a generally nonremovable attachment of the two runs by crimping or squeezing the fastener 36. The run 35 terminates at end 38 at or near the fastener 36. The run 33 continues through the fastener 36 and further includes an extension or trailing end 50. The trailing end 50 of the first loop 32 is contiguous with the trailing end 50 of the second loop 32, thereby defining main body portion 30 of the device 10.

In the depicted embodiment, the fasteners 36 are depicted as metal clasps or clamps of a type which may be crimped to nonreleasably secure the cord ends 38 to the main body portion 30. However, other types of fasteners may also be employed, including permanent adhesives, wire clamps, threads, strands or wires tightly wrapped around the cord ends 38 and the main body portion 30 to firmly secure the same, and the like.

The article 10 may be of any dimension 46, and is preferably dimensioned to be equal to or, preferably, greater than a standard or typical uniform button spacing 48 commonly found on shirts. In certain embodiments, the article 10 has a dimension 46 which is about 0.5 to about 1.5 inches greater than the button spacing. Thus, for example, in the case of a typical uniform button spacing of about 3.25 to about 3.5 inches, a preferred dimension 46 may be about 3.75 to about 5 inches, most preferably about 4.25 inches.

Figure 3:
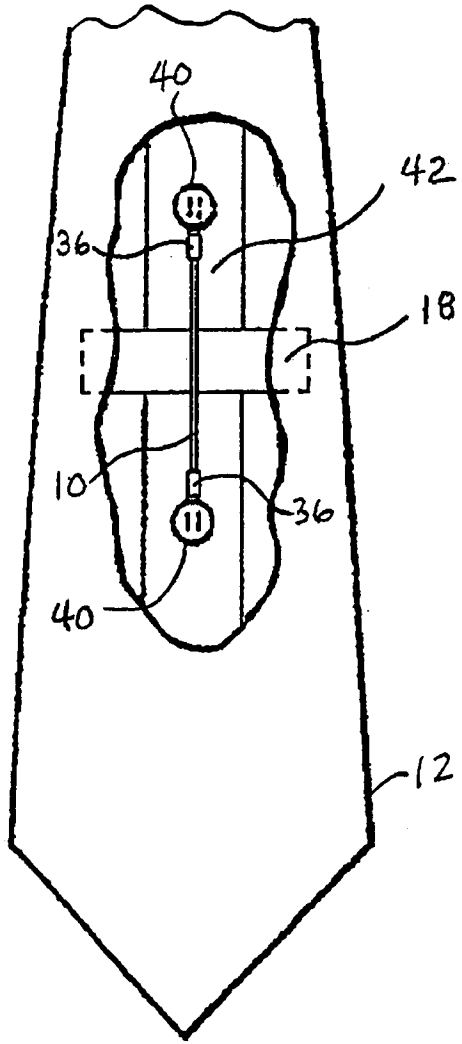
FIG. 3 is a fragmentary view of a necktie with cutaway, showing a neck apparel restraint of the present invention attached to the necktie and shirt buttons.

In operation, the necktie restraining device 10 is passed through the opening 24, as best seen in FIGS. 2 and 3. Buttons 40 are then passed through openings 34 defined by the button loops 32 to removably secure the device 10.

Figure 4:
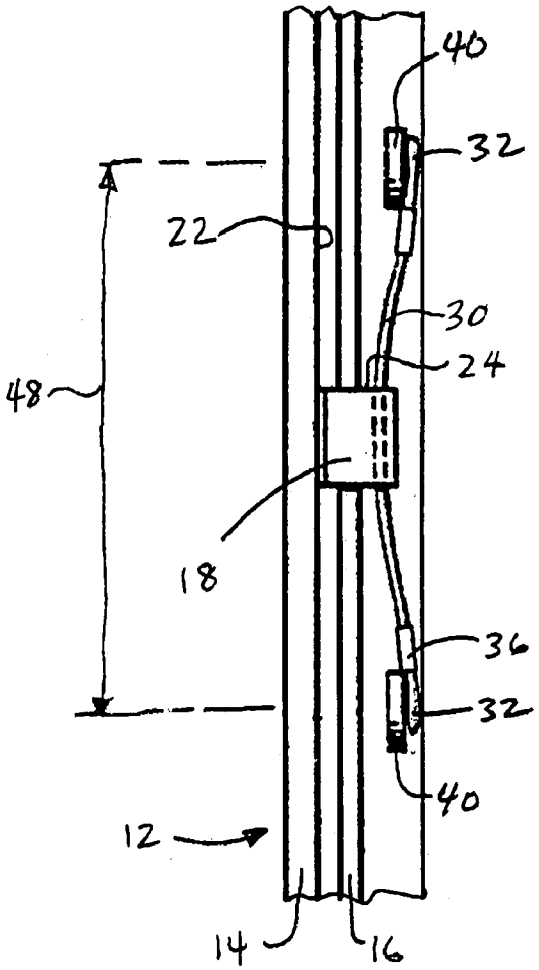
FIG. 4 is a fragmentary side view of a neckwear restraint of the present invention attached to the necktie and adjacent shirt buttons.

As shown in greater detail in the fragmentary side view of FIG. 4, the neck apparel restraining device 10 is disposed vertically, generally in axial alignment with the necktie 12 and the row of buttons 40 of the shirt 42 of the wearer. The restraining device 10 slidably engages the loop member 18 which is attached to the rearward or inward facing surface 22 of the wide tail 14 of the of the necktie 12. The narrow tail 16 of the necktie 12 is also received through the passage 24.

Again, the apparel restraining device 10 includes two button loops 32 on opposite ends of the device for releasably engaging the restraining device with adjacent uniformly spaced apart shirt fastening buttons 40. As stated above, it is preferable that the distance 46 be greater than the distance 48 between the buttonholes 40. The sliding engagement between the loop member 18 and the main body portion 30 of the device 10 allows movement of the necktie 12 relative to the buttons 40 and device 10 in the long direction of the tie, i.e., the vertical direction in the orientation shown. Furthermore, the elasticity of the device 10 allows the device to stretch, thereby providing an additional range of motion or give when movements of the wearer so demand. Thus, even after the loop member 18 has reached an end of its range of travel with respect to the device 10, the elasticity of the device 10 allows additional elongation of the device 10, thereby providing additional comfort to the wearer while the tension of the elastic cord retains the tie in the desired centered and straight down position.

Figure 6:
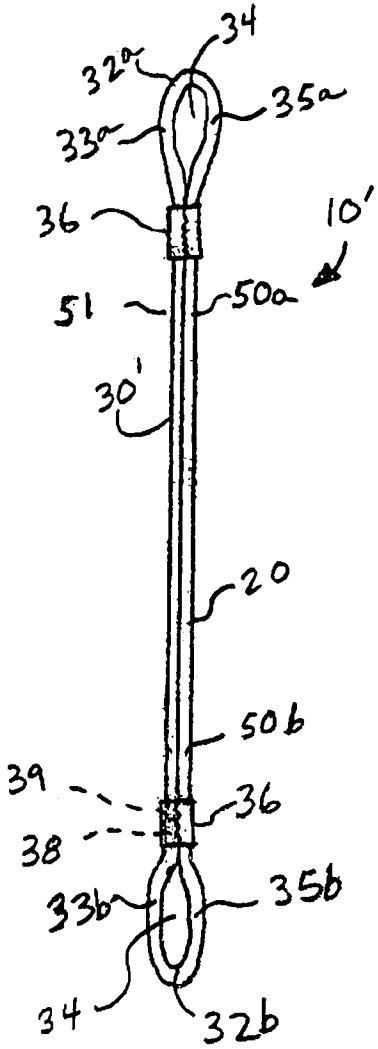
FIG. 6 illustrates a necktie restraining device according to a second embodiment of the present invention.

Referring now to FIG. 6, there is shown an alternative a necktie restraining device 10' of the present invention. The necktie restraining device 10' includes an elastic cord 20 of a type described above forming a peripheral loop and having button loops 32*a* and 32*b* formed at opposite ends thereof and defining openings 34*a* and 34*b*, respectively. The loops 32*a* and 32*b* are formed by fasteners 36*a* and 36*b*, respectively, which are crimped or clamped onto the peripheral cord forming the device 10', thereby defining a main body portion 30' therebetween, with the fasteners 36*b* additionally securing the cord ends 38 and 39 together.

The loop 32*a* of the device 10' includes first and second runs 33*a* and 35*a*, respectively, of the elastic cord and which are nonremovably interconnected in side-by-side manner by the fasteners 36*a*. The runs 33*a* and 35*a* pass through the end of the fastener 36*a* proximate the loop 32*a* and trailing ends 50*a* and 51 extend from the opposite end of the fastener 36*a*.

The loop 32*b* of the device 10' includes first and second runs 33*b* and 35*b*, respectively, of the elastic cord and which are nonremovably interconnected in side-by-side manner by the fasteners 36*b*. The run 33*b* terminates at end 38 within the fastener 36*b*. The run 35*b* passes through the end of the fastener 36*b* proximate the loop 32*b* and trailing end 50*b* extends from the opposite end of the fastener 36 and is contiguous with the trailing end 50*a*, thereby forming a first strand of the main body portion 30'. The trailing end 51 of the run 33*a* terminates at an end 39 which is brought into proximity with the end 38 to define a peripheral loop. The end 39 is nonremovably secured to both end 38 and run 35*b* via the fastener 36.

The invention has been described with reference to the preferred embodiment. Modifications and alterations will occur to others upon a reading and understanding of the preceding detailed description. For example, it will be recognized that the neck apparel restraining device 10 of the present invention is not limited to neckties and/or neck apparel with permanently attached loop members 18 and the device 10 may be used with tie clips, scarf clips, or like device forming a passage through which the device 10 may pass prior to securing the device 10 to shirt buttons of the wearer. It is intended that the invention be construed as including all such modifications and alterations.

Having thus described the preferred embodiments, the invention is now claimed to be:

1. A neck apparel restraining device for attaching an item of neck apparel in place on a shirt of a person wearing an item of neck apparel, the shirt being of a type having a plurality of buttons spaced along its front, said restraining device comprising:

an elongate flexible cord;

a first button loop formed at a first end of said cord;

a second button loop formed at a second end of said cord opposite the first end;

said first and second button loops adapted to releasably engage adjacent ones of the plurality of shirt buttons.

2. The device of claim 1, wherein the neck apparel item is a necktie.

3. The device of claim 1, wherein the elongate flexible cord is an elastic cord.

4. The device of claim 1, wherein the elongate flexible cord comprises one or more elastic strands bound in a woven casing.

5. The device of claim 1, further comprising:

each of the first and second button loops comprising first and second runs of the elongate flexible cord;

for each of the first and second button loops, a fastener nonremovably interconnecting said first and second runs in side-by-side manner;

for each of the first and second button loops, the first run terminating at or near the fastener and the second run continuing through the fastener and comprising a trailing end, wherein the trailing end of the first button loop is contiguous with the trailing end of the second button loop.

6. The device of claim 1, further comprising:

the first button loop comprising first and second runs of the elongate flexible cord;

a first fastener nonremovably interconnecting said first and second runs of the first button loop in side-by-side manner;

the first run of the first button loop terminating at or near the first fastener and the second run continuing through the fastener and comprising a first trailing end;

the second button loop comprising third and fourth runs of the elongate flexible cord;

a second fastener nonremovably interconnecting said third and fourth runs of the second button loop in side-by-side manner;

the third and fourth runs of the second button loop continuing through the fastener and comprising second and third trailing ends, the second trailing end being contiguous with the first training end and the third trailing end being secured to the first and second runs by the first fastener.

7. The device of claim 1, wherein said first and second button loops are adjoined to opposite ends of an elastic cord.

8. The device of claim 1, wherein the shirt buttons are uniformly spaced.

9. The device of claim 8, wherein the shirt buttons are spaced in accordance with a standard button spacing.

10. The device of claim 1, having a length of from about 3.25 to about 5.0 inches.

11. The device of claim 10, wherein the device has a length of from about 4.0 to about 4.5 inches.

12. A method of securing a neck apparel item to a shirt having a plurality of spaced-apart buttons, comprising:

providing an item of neck apparel of a type having at least a portion to be worn in a centered position on a shirt, the item of neck apparel further including a loop member defining an opening;

placing a restraining device through the loop member, the restraining device comprising an elongate flexible cord, a first button loop formed at a first end of said cord, and a second button loop formed at a second end of said cord opposite the first end;

removably attaching the first button loop to a first button on the shirt, the first button being the most proximate button on the shirt to the first button loop;

removably attaching the second button loop to a second button on the shirt, the second button being the most proximate button on the shirt to the second button loop.

13. The method of claim 12, wherein the neck apparel item is a necktie.

14. The method of claim 12, wherein the elongate flexible cord is an elastic cord.

15. The method of claim 12, wherein the elongate flexible cord comprises one or more elastic strands bound in a woven casing.

16. The method of claim 12, wherein the restraining device further comprises:

each of the first and second button loops comprising first and second runs of the elongate flexible cord;

for each of the first and second button loops, a fastener nonremovably interconnecting said first and second runs in side-by-side manner;

for each of the first and second button loops, the first run terminating at or near the fastener and the second run continuing through the fastener and comprising trailing end, wherein the trailing end of the first button loop is contiguous with the trailing end of the second button loop.

17. The method of claim 12, wherein the restraining device further comprises:

the first button loop comprising first and second runs of the elongate flexible cord;

a first fastener nonremovably interconnecting said first and second runs of the first button loop in side-by-side manner;

the first run of the first button loop terminating at or near the first fastener and the second run continuing through the fastener and comprising a first trailing end;

the second button loop comprising third and fourth runs of the elongate flexible cord;

a second fastener nonremovably interconnecting said third and fourth runs of the second button loop in side-by-side manner;

the third and fourth runs of the second button loop continuing through the fastener and comprising second and third trailing ends, the second trailing end being contiguous with the first training end and the third trailing end being secured to the first and second runs by the first fastener.

18. The method of claim 12, wherein said first and second button loops are adjoined to opposite ends of an elastic cord.

19. The method of claim 12, wherein the shirt buttons are uniformly spaced.

20. The method of claim 19, wherein the shirt buttons are spaced in accordance with a standard button spacing.

21. The method of claim 12, wherein the device has a length of from about 3.25 to about 5.0 inches.

22. The method of claim 21, wherein the device has a length of from about 4.0 to about 4.5 inches.

23. The method of claim 12, wherein the neck apparel item is a necktie of a type having a wide tail and a narrow tail, and further comprising:

inserting the narrow tail through the opening.

24. The method of claim 12, wherein the second button is adjacent the first button.

25. A necktie restraining device for attaching a necktie in place on a shirt of a person wearing a necktie, the shirt being of a type having a plurality of buttons spaced along its front, the necktie being of a type having a tie loop formed on an inward facing surface thereof, said restraining device comprising:

an elongate elastic cord;

a first button loop formed at a first end of said cord;

a second button loop formed at a second end of said cord opposite the first end;

said first and second button loops adapted to releasably engage adjacent ones of the plurality of shirt buttons.

* * * * *